United States Patent [19]

Frauenfelder

[11] 4,093,431

[45] June 6, 1978

[54] RAPPING ASSEMBLY AND ELECTRODE SUPPORTS FOR ELECTROSTATIC PRECIPITATORS

[75] Inventor: Alfred Frauenfelder, Zollikerberg, Switzerland

[73] Assignee: American Air Filter Company, Inc., Louisville, Ky.

[21] Appl. No.: 749,674

[22] Filed: Dec. 13, 1976

[51] Int. Cl.[2] ..... B03C 3/76

[52] U.S. Cl. ..... 55/112; 74/128; 55/146

[58] Field of Search ..... 55/112, 146, 300; 74/128

[56] References Cited

U.S. PATENT DOCUMENTS

| | | | |
|---|---|---|---|
| 1,648,364 | 11/1927 | Roscoe | 74/128 |
| 1,741,352 | 12/1929 | Viets et al. | 55/112 |
| 1,939,887 | 12/1933 | Ferris et al. | 74/128 |
| 3,427,787 | 2/1969 | Hilge | 55/112 |
| 3,487,606 | 1/1970 | Bridges | 55/112 |
| 3,531,918 | 10/1970 | Vegeby | 55/146 |

FOREIGN PATENT DOCUMENTS

| | | | |
|---|---|---|---|
| 878,869 | 10/1961 | United Kingdom | 55/112 |

*Primary Examiner*—Bernard Nozick
*Attorney, Agent, or Firm*—Charles Lamb

[57] ABSTRACT

A device for rapping electrode carriers and supporting same within an electrostatic precipitator whereby dust accumulating upon electrodes extending vertically from the electrode carriers are removed. The rapping assembly and electrode support means are suspended from the roof of an electostatic precipitator wherein the electrode support means includes a rapping shaft drive means at the lower end thereof and electrode carrier means. The rapping shaft drive means is in driving relation with a rapping shaft wherein the rapping shaft rotates at a preselected rate and includes a plurality of rapping members attached thereto, each rapping member being disposed to rap each electrode carrier which in turn sends vibrations through the electrodes which extend vertically downwardly from the electrode carriers thereby removing dust accumulating on the electrodes.

7 Claims, 5 Drawing Figures

RAPPING ASSEMBLY AND ELECTRODE SUPPORTS FOR ELECTROSTATIC PRECIPITATORS

BACKGROUND OF THE INVENTION

The invention relates to a rapping assembly and electrode support means for electrostatic precipitators and more particularly relates to the rapping shaft drive means and rapping shaft supports for electrostatic precipitators wherein the rapping shafts and electrode support means are suspended from the roof of an electrostatic precipitator.

Electrostatic precipitators are provided with discharge and collecting electrodes which attract particulate matter from contaminated air streams passing through the precipitator. Particulate matter or dust which piles up on these electrodes must be removed by shaking or washing of these electrodes. Normally the shaking is accomplished by vibrators or rapping devices. The rapping devices usually include a rotating shaft with tumbling rappers affixed thereto, each of the rappers being disposed to strike a rapper receiving means attached to one or more carriers for discharge or collecting electrodes, the striking sending vibrations through the electrodes thereby dislodging dust accumulating thereon. These rotating rapping shafts are connected to high voltage electrical sources and in many instances extend through the sidewall of a precipitator housing and are electrically insulated with respect to the housing and the drive motor. This type of construction has the disadvantage in that the distance of the electrostatic precipitator from other electrically driven machines presents an unsafe condition as the drive motor for the rapping shaft projects outwardly from the vertically extending sidewalls of the precipitator housing. In U.S. Pat. No. 3,427,787 a device is described which includes a rapping shaft suspended from the roof of an electrostatic precipitator with the driving means for the rapping shaft being attached to the precipitator roof. However, the suspension of the discharge system and the drive of the rapping shaft requires at least three openings in the precipitator roof. It is noted that the opening for the driving rod for the rapping shaft is relatively large in order to avoid any electrical arc-overs. As a result, the insulator is placed in the dust-laden gas stream and during operation the insulator is susceptible to being covered with a layer of dust. Furthermore, during shutdown periods for the precipitator, the dust-layer on the insulator may become humid, thus increasing the danger of arc-overs when the high voltage is reapplied to the device. Also, the drive mechanism for the rapping shaft is a ratchet device which is disposed within the gas stream and is subjected to particulate build-up, the particulate build-up interfering with efficient operation of the ratchet device.

SUMMARY OF THE INVENTION

In the present invention it is recognized that it is desirable to provide a rapping assembly for an electrostatic precipitator. Furthermore, it is recognized that it is desirable to provide a rapping assembly for an electrostatic precipitator supported from the roof of an electrostatic precipitator and driven by drive means also mounted onto said roof. Even further, it is recognized that it is desirable to provide a rapping assembly which is not subject to particulate build-up during operation.

According to the present invention, a rapping assembly for a rapping shaft of an electrostatic precipitator as well as the frame carrying ionizing electrodes thereon are suspended from the roof of an electrostatic precipitator wherein the suspension means is in the center of the electrical field of the precipitator. A rotating rapping shaft with tumbling rappers fastened thereto is placed on top of an upper discharge frame which also supports bearings for the aforementioned rapping shaft. The rapping shaft is put into a rotating motion by a rapping shaft drive means which is preferably a pin wheel drive actuated by appropriate drive means wherein the rappers attached to the rotating rapper shaft rap the electrode carrying members at substantially the center of each carrying member. The electrode carrying members have attached thereto ionizing electrodes which extend vertically downwardly therefrom whereby the vibrations to the carrying members extend in opposite directions toward the ionizing electrodes. In the operation of the present invention, utilizing a pin wheel attached to the rapping shaft in combination with appropriate drive means alleviates the problem of particulate build-up in the rapping shaft drive means as dust in the gas stream passing through the precipitator will pass through the pin wheel.

More particularly, the present invention provides in combination with an electrostatic precipitator having a housing with a flow-through inlet and a flow-through outlet and a plurality of discharge and collecting electrodes therein, the housing including an opening in the upper portion thereof with a rapping assembly extending therethrough, the rapping assembly for the discharge electrodes comprising: an electrically insulated cover means covering the opening; vertically extending reciporcating support means having an upper end extending through the cover, insulator means for the reciprocating support means, the lower end of the support means having a pin wheel drive means mounted thereon; actuating means in communication with the reciprocating support means; a vertically extending stationary support means attached to the insulated cover means at its upper end and having electrode carrying means mounted onto its lower end; the electrode carrying means having a plurality of the discharge electrodes attached thereto and at least one rapper receiving means thereon; the electrode carrying means including rapper shaft support means thereon supporting a horizontally extending rapper shaft, the rapper shaft including at least one rapper thereon, the rapper being in alignment with and received by the rapper receiving means, the rapper shaft including a pin wheel thereon in alignment with and driven by the pin wheel drive means whereby the rapper shaft is rotated at a preselected rate.

It is to be understood that the description of the examples of the present invention given hereinafter are not by way of limitation, and various modifications within the scope of the present invention will occur to those skilled in the art upon reading the disclosure set forth hereinafter.

Referring to the drawings.

Figure 1:
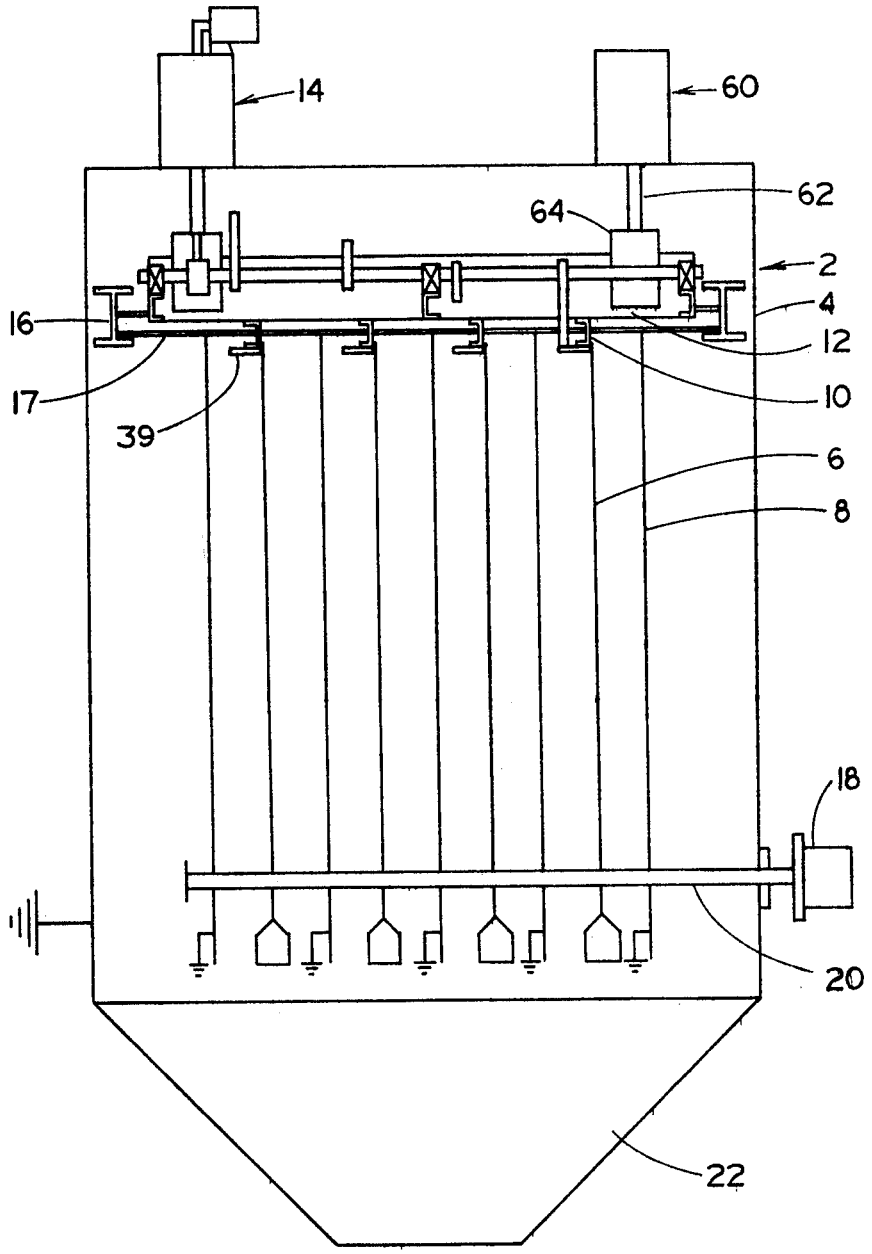
FIG. 1 is a schematic illustration of a portion of a typical electrostatic precipitator having conventional electrode rappers utilizing a preferred rapping assembly of the present invention.
Figure 2:
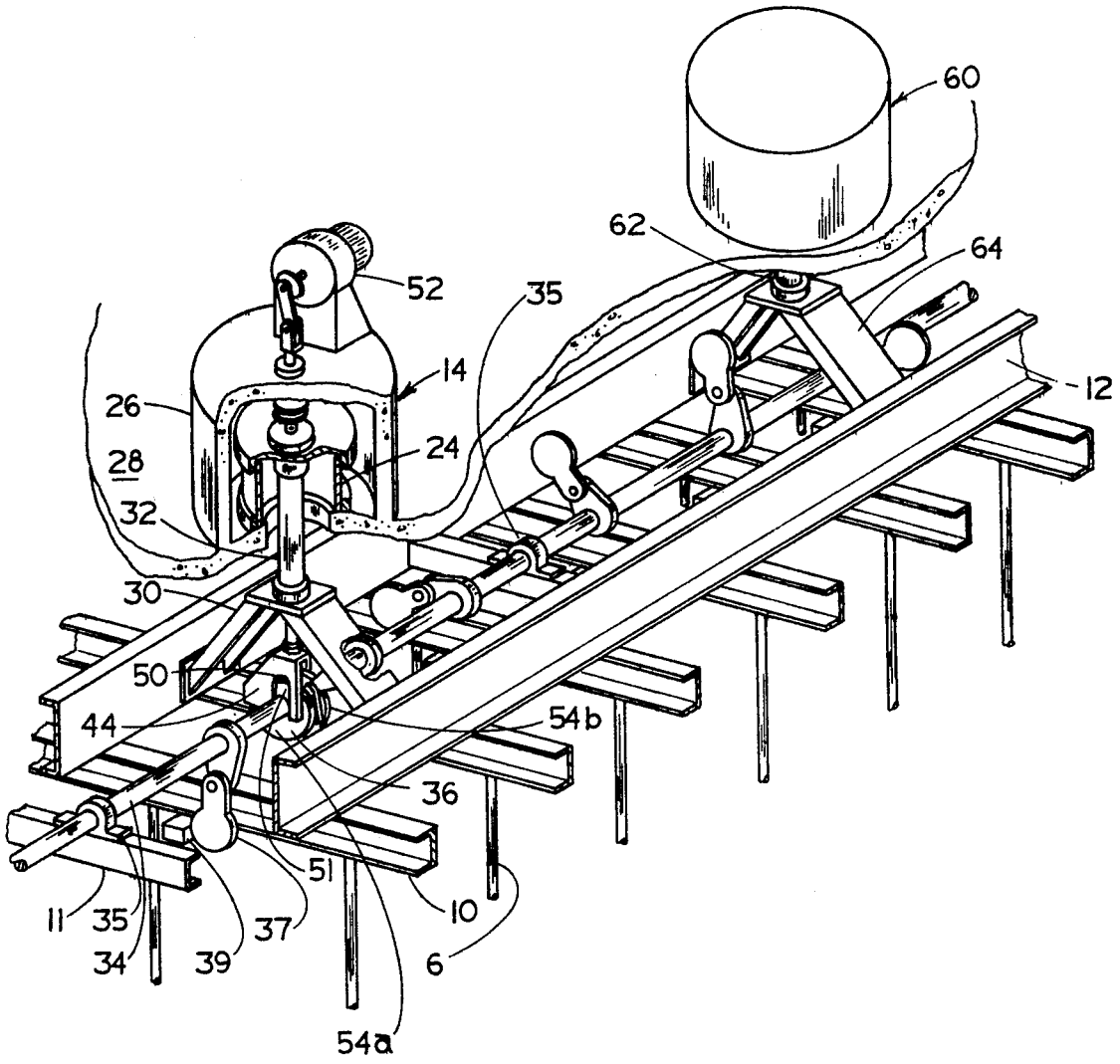
FIG. 2 is a perspective view with selected portions cut-away of the rapping assembly as shown in FIG. 1.
Figure 3:
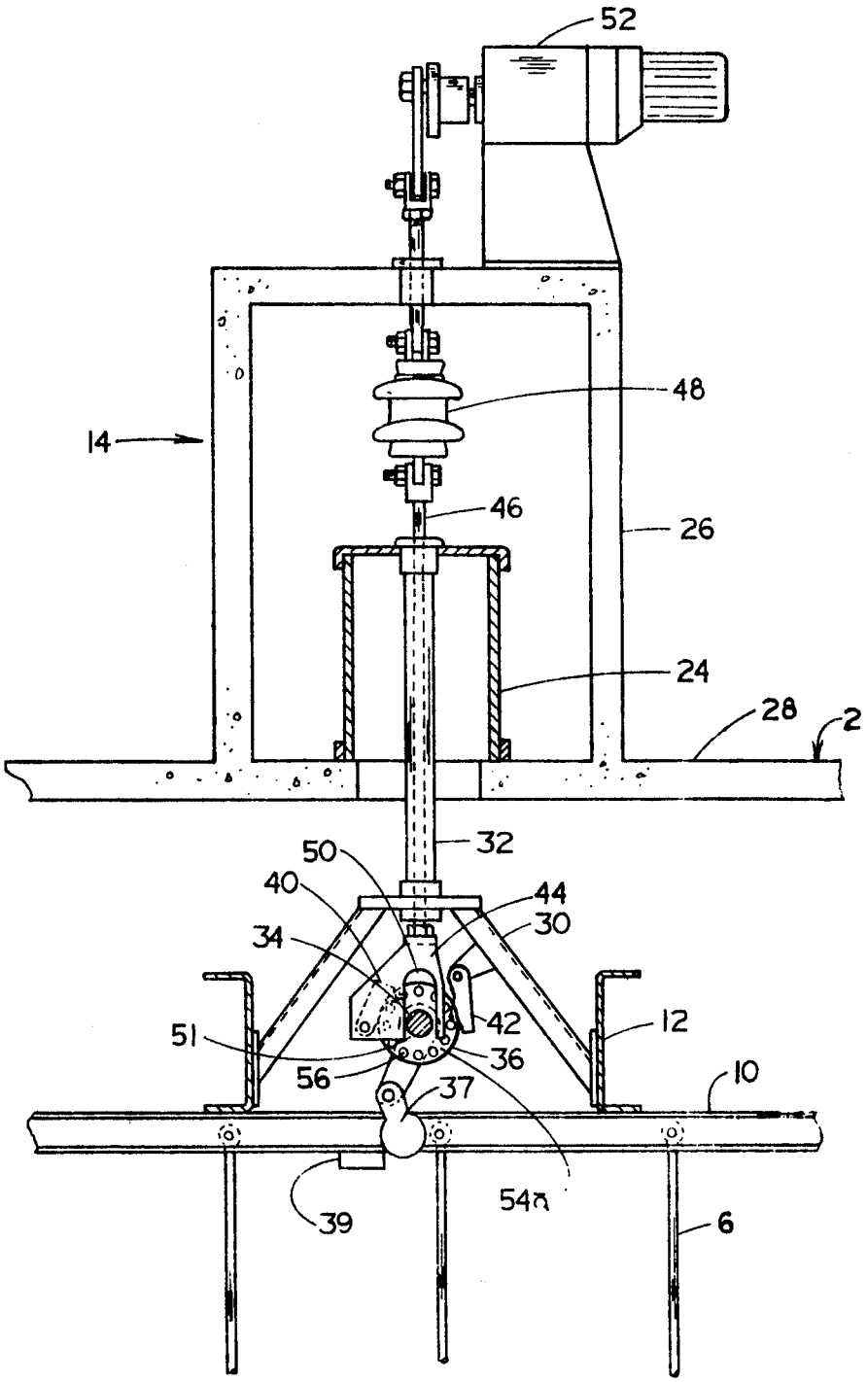
FIG. 3 is a sectional view illustrating the rapping assembly of the present invention as shown in FIG. 1.

In the accompanying drawings, in FIG. 1, there is illustrated an electrostatic precipitator utilizing the rapping shaft assembly as herinafter described and shown in FIGS. 2 and 3. As shown, an electrostatic precipitator generally designated by the numeral 2 is provided with an outer shell 4 which directs a flow of particle-laden gases past a plurality of discharge electrodes 6 and a plurality of collector plates 8. The discharge electrodes 6 are supported by structural members 10 illustrated as channel members which are themselves supported by transversely extending channel members 12. The transversely extending support members 12 are supported from the rapping assembly 14, to be discussed hereinafter.

The discharge electrodes are supplied with high voltage electric current by means of any conventional system (not shown) which are known in the art.

The rapping shaft assembly is further supported at the opposite end of the housing 2 by a roof mounted support assembly including a support housing 60 with a vertically extending support member 62 attached thereto and extending downwardly therefrom. The support member 62 has attached at its lower end a yoke 64 which in turn is attached to and supports the transversely extending channel members 12.

As the particle-laden gas passes through shell 4, the particles are charged in the ionization field between the discharge electrode wires 6 and collector plates 8. The charged particles migrate toward the flat surfaces of the plate 8 and collect thereon. These collected particles must be removed periodically to maintain efficient collection. The collector electrodes 8 are supported by structural members which are an integral part of shell 4, the structural members being illustrated as a pair of I-beams at opposite sides of the shell 4 with a transversely extending member 17 disposed therebetween, the electrodes 8 being attached to the member 17. Electrodes 8 are also rapped by a rapping source 18 connected to the electrodes 8 by a rod 20. The rapping source for the collecting electrodes or plates 8 may be by any means known in the art, the electrodes being vibrated whereby accumulated dust particles are dislodged therefrom and fall into a hopper 22 from which they are periodicaly removed.

In FIGS. 2 and 3 a detailed rapping assembly 14 of the present invention is shown. A supporting high tension insulator 24 is mounted in housing 26 on top of the roof 28 of the precipitator 2. The insulator 24 has attached thereto a vertically extending suspension tube 32 which supports a yoke 30 and the support members 12 which are installed across the gas flow through the precipitator 2. Cross beams 10 having the discharge electrodes 6 attached thereto are connected to and supported by support members 12.

Support members 12 also support channel support members 11, the top sides of the support members 11 having bearings 35 mounted thereon to receive the rapping shaft 34 therethrough. Tumbling hammers 37 are pivotally mounted onto rapping shaft 34, each hammer 37 being positioned above and in alignment with an electrode carrying support member 10. Electrode support members 10 are provided with anvils 39 affixed on the bottom side thereof to receive the pivotally attached hammers 37 which are moved upon rotary movement of the rapping shaft 34. It is realized that the anvils may be affixed on the top side of electrode support members 10 also, but usually it is desirable to keep the distance between the roof 28 and the rapping shaft 34 to a minimum.

The rapping shaft 34 is also provided with a pin wheel 36 which is the driving means for the rapping shaft 34. Pin wheel 36 includes a pair of spaced discs 54*a* and 54*b* with a plurality of pins 56 equally spaced around the outer periphery thereof and extending through aligned apertures in the discs 54*a* and 54*b*. The pin wheel 36 is rotated by the upward movement of a pushing pawl 40 which engages with and pushes upward against pins 56. Pushing pawl 40 is pivotally attached by pivot pin 49 to and supported by a lifting box 44 which is mounted onto a vertically extending reciprocating rod 46, the lifting box 44 moving upwards and downwards upon movement of rod 46 which is driven by motor drive means 52. The pushing portion of the pawl 40 is the upper surface 41*a* of the inwardly extending finger 41, upper surface 41*a* having a radius of curvature of approximately the same as the radius of curvature of the pins 56 and disposed to engage with the pins 56 upon the aforementioned upward movement of rod 46. The finger 41 is further provided with a lower surface 41*b* which has a radius of curvature equal to or greater than the pin 56 so that upon downward movement of rod 46, surface 41*b* moves around the pins 56 to provide engagement therewith upon the next upward movement of the rod 46.

A locking pawl 42 is pivotally attached by pivot pin 45 to an inwardly extending support 43 which is attached to the yoke 30. Pawl 42 is provided to lock the pin wheel 36 in position after each termination of the upward movement of the rod 46. Pawl 42 is provided with an inwardly extending finger 47 having a lower surface 47*a* with approximately the same radius of curvature as pin 56 and disposed to engage with pin 56, preventing pin 56 from rotating counter-clockwise (as viewed in FIGS. 4 and 5) when rod 46 starts its downward movement. Finger 47 is further provided with an upper surface 47*b* which has a radius of curvature greater than pins 56 so that upon clockwise movement of the pin wheel 36, pawl 42 moves outwardly and around the pins 56 as they pass underneath.

Figure 4:
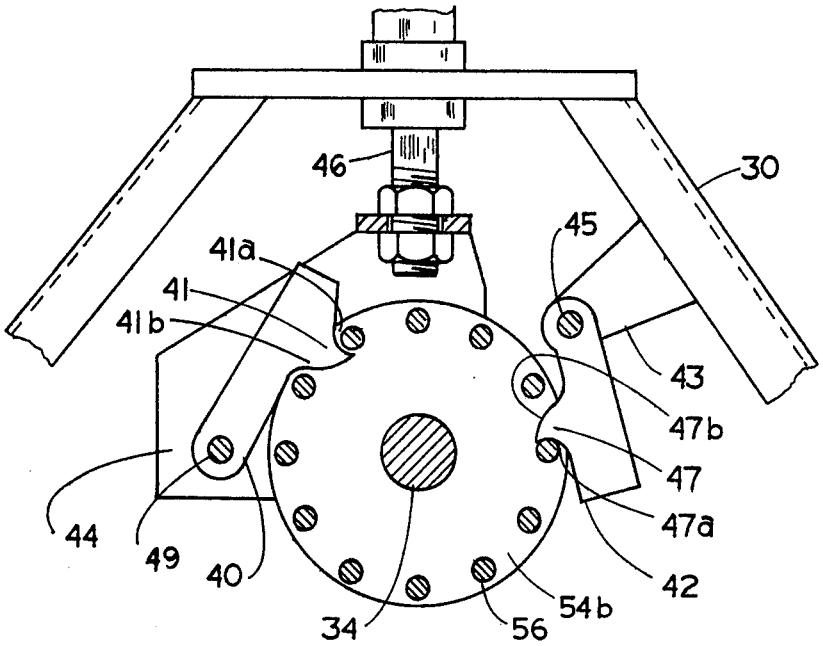
FIG. 4 is a detail of the pin wheel and drive device of the rapping assembly illustrated in FIG. 3 when the drive device is in its lowest position; and, FIG. 5 is a detail of the pin wheel and drive device of the rapping assembly illustrated in FIG. 3 when the drive device is in its uppermost position.
Figure 5:
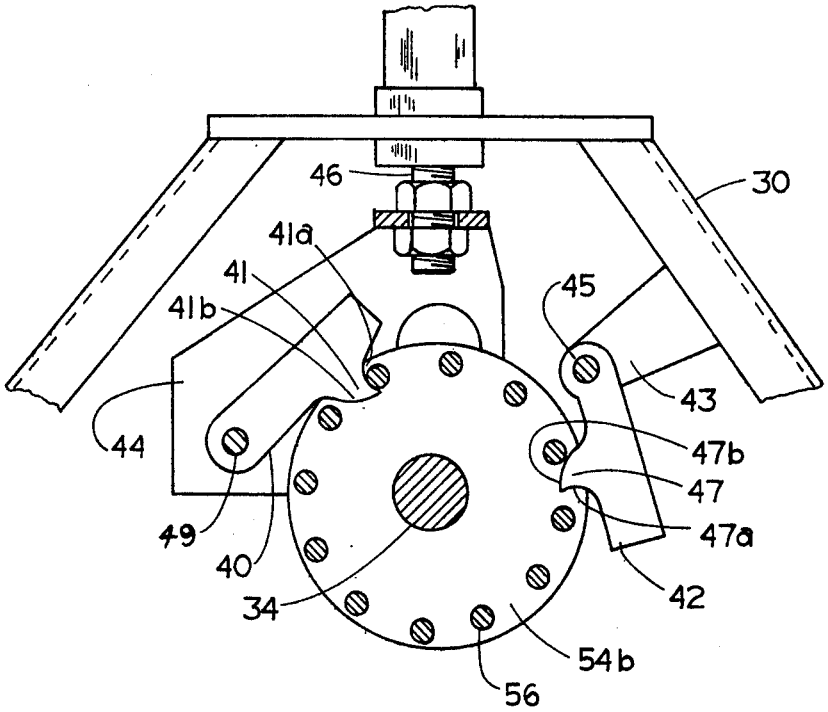

In FIG. 4, rod 46 is in its lowermost position with pawl 42 locking the pin wheel 36 in place and in FIG. 5, rod 46 is in its uppermost position with pushing pawl 40 engaging with a pin 56 thereby rotating the pin wheel 36. The lifting box 44 is provided with a fork 50 at its lower extremity. Fork 50 includes a slot 51 therein of sufficient vertical length for reciprocating movement of rod 46 and sufficient width to interlock rapping shaft 34 thereby preventing it from moving sidewise. However, it is realized that other interlocking mechanisms may be utilized without departing from the spirit and scope of the present invention.

An insulator 48 is provided to electrically insulate the rod 46 from a drive 52 which is disposed outside the insulator box 26. The drive 52, for example, a geared motor, can be placed on top of the insulator housing 26 or may be placed inside the housing 26. Other means for driving the rod 46 in an upwards and downwards movement may also be utilized without departing from the scope and spirit of the present invention.

It is also realized that other changes may be made to the specific embodiment shown and described without departing from the principals and spirit of the present invention.

What is claimed is:

1. In combination with an electrostatic precipitator having a housing with a flow-through inlet and a flow-through outlet and a plurality of discharge and collecting electrodes disposed therein defining an electrostatic field therebetween, said housing including an opening in the upper portion thereof with a rapping assembly extending therethrough, said rapping assembly for said discharge electrodes comprising:

an electrically insulated cover means covering said opening;

a vertically extending reciprocating support means having an upper end extending through said cover, insulating means insulating said reciprocating support means, the lower end of said support means having a pin wheel drive means mounted thereon;

driving means driving said reciprocating support means;

a vertically extending stationary support tube encircling said vertically extending reciprocating means attached to said insulated cover means at its upper end and having electrode carrying means mounted onto its lower end;

said electrode carrying means having a plurality of said discharge electrodes attached thereto and at least one rapper receiving means mounted onto said electrode carrying means;

said electrode carrying means including rapper shaft support means thereon supporting a horizontally extending rapper shaft, said rapper shaft including at least one rapper thereon, said rapper being in alignment with and received by said rapper receiving means, said rapper shaft including a pin wheel therein in alignment with and driven by said pin wheel drive means whereby said rapper shaft is rotatable at a preselected rate.

2. The combination of claim 1, said vertically extending stationary support means including a yoke mounted onto the lower end thereof, said yoke having a pair of first support members attached to the lower ends of opposed legs of said yoke, said first support members being normal to the flow of gases through said housing; a second support member attached transversely of said first support members, said second support member having said discharge electrodes attached thereto and said at least one rapper receiving means thereon.

3. The combination of claim 2, said pin wheel drive means including a lifting box mounted onto said lower end of said reciprocating support means, said lifting box having pivotally attached thereto a pushing pawl engaging with said pin wheel, said yoke having pivotally attached thereto a locking pawl engaging with said pin wheel.

4. The combination of claim 3, said lifting box being provided with a fork at its lower extremity, the legs of said fork being spaced from and on opposed sides of said rapping shaft thereby preventing sidewise movement of said rapping shaft.

5. The combination of claim 3, said pin wheel including a pair of opposed spaced discs mounted onto said rapping shaft with a plurality of pins equally spaced around the outer periphery thereof and extending through aligned apertures in said discs, said pawls being engageable with said pins.

6. The combination of claim 5, said pushing pawl having an inwardly extending finger with an upper surface thereon, said upper surface having a radius of curvature of approximately the same as the radius of curvature of said pins engageable with said pins upon upward movement of said vertically extending reciprocating support means, said finger having a lower surface with a radius of curvature equal to or greater than said pin whereby upon downward movement of said reciprocating support means said lower surface moves around said pins.

7. The combination of claim 5, said locking pawl having an inwardly extending finger with a lower surface approximately the same radius of curvature as said pins and engageable with said pins whereby said engagement prevents said pin wheel from rotating when said reciprocating support means moves downwardly, said finger having an upper surface with a radius of curvature greater than said pins whereby upon upward movement of said reciprocating support means said lower surface moves outwardly and around said pins.

* * * * *